US011457312B1

(12) United States Patent
Sira

(10) Patent No.: US 11,457,312 B1
(45) Date of Patent: Sep. 27, 2022

(54) SYSTEMS AND METHODS FOR ACTIVE NOISE CANCELLATION INCLUDING SECONDARY PATH ESTIMATION FOR PLAYBACK CORRECTION

(71) Applicant: Cirrus Logic International Semiconductor Ltd., Edinburgh (GB)

(72) Inventor: Sandeep P. Sira, Gilbert, AZ (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 17/358,485

(22) Filed: Jun. 25, 2021

(51) Int. Cl.
*H04R 3/02* (2006.01)

(52) U.S. Cl.
CPC ..... *H04R 3/02* (2013.01); *H04R 2460/01* (2013.01)

(58) Field of Classification Search
None
See application file for complete search history.

(56) References Cited

U.S. PATENT DOCUMENTS

2020/0058285 A1* 2/2020 Parikh ..... G10K 11/17823

OTHER PUBLICATIONS

Combined Search and Examination Report under Sections 17 and 18(3), UKIPO, Application No. GB2205717.8, dated Jun. 9, 2022.

* cited by examiner

*Primary Examiner* — Kenny H Truong
(74) *Attorney, Agent, or Firm* — Jackson Walker L.L.P.

(57) ABSTRACT

A device may include a housing, a transducer coupled to the housing for reproducing an audio signal including both a source audio signal for playback to a listener and an anti-noise signal for countering the effects of ambient audio sounds in an acoustic output of the transducer, an error microphone coupled to the housing in proximity to the transducer for providing an error microphone signal indicative of the acoustic output of the transducer and the ambient audio sounds at the transducer, and a processing circuit. The processing circuit may implement a feedback filter having a response that generates the anti-noise signal from a playback corrected error, the playback corrected error based on a difference between the error microphone signal and a secondary path estimate signal, an adaptive secondary path estimate filter configured to model an electro-acoustic path of the source audio signal and have a secondary path estimate response that generates the secondary path estimate signal from the source audio signal, and a coefficient control block that shapes the response of the secondary path estimate filter in conformity with a reference signal and an internal error signal in order to minimize the ambient audio sounds at the transducer, wherein the reference signal is equal to a sum of the source audio signal and the anti-noise signal.

12 Claims, 4 Drawing Sheets

SYSTEMS AND METHODS FOR ACTIVE NOISE CANCELLATION INCLUDING SECONDARY PATH ESTIMATION FOR PLAYBACK CORRECTION

FIELD OF DISCLOSURE

The present disclosure relates in general to active noise cancellation in connection with an acoustic transducer, and more particularly, to detection and cancellation of ambient noise present in the vicinity of the acoustic transducer using feedback active noise cancellation techniques and including using a sum of a playback signal and feedback anti-noise as a reference signal for adaptation of an estimate of a secondary path.

BACKGROUND

Wireless telephones, such as mobile/cellular telephones, cordless telephones, and other consumer audio devices, such as mp3 players, are in widespread use. Performance of such devices with respect to intelligibility can be improved by providing noise canceling using a microphone to measure ambient acoustic events and then using signal processing to insert an anti-noise signal into the output of the device to cancel the ambient acoustic events.

In a feedback active noise cancellation system, an error microphone is used to generate an error microphone signal that measures a combined acoustic pressure including playback of a source audio signal and ambient sounds. The error microphone signal is used to generate feedback anti-noise.

In generating the feedback anti-noise, it is critical that the feedback noise cancelling system cancel only ambient noise at the error microphone, but not the playback signal. Accordingly, a feedback active noise cancellation system will often generate a playback corrected error signal equal to the error microphone signal that is typically reduced by a filtered version of the source audio signal, wherein the filter estimates the secondary path, which is the electro-acoustic path of between a source of the source audio signal and an acoustic transducer (e.g., a loudspeaker). If modeled correctly, the playback corrected error signal will be approximately equal to the ambient noise level present at the acoustic transducer.

In traditional approaches, an adaptive filter used to model the secondary path receives a reference signal (sometimes referred to as a training signal) and a desired response signal (e.g., a signal generated by the error microphone) as inputs. Such approaches typically use the playback signal or a synthetic noise source as the reference signal. An example active noise cancellation (ANC) circuit 130 that employs such traditional approach, which may be referred to as the "filtered-error approach," is depicted in FIG. 4.

As depicted in FIG. 4, ANC circuit 130 may comprise a feedback filter 144. Feedback filter 144 may receive the playback corrected error signal PBCE and may apply a response FB(z) to generate a feedback anti-noise signal based on the playback corrected error which may be provided to an output combiner that combines the anti-noise signal with a source audio signal to be reproduced by the transducer. Also as depicted in FIG. 4, a path of the feedback anti-noise signal may have a gain element 146, wherein a gain of such gain element 146 may be programmable, such that an increased gain will cause increased noise cancellation of the feedback anti-noise, and decreasing the gain will cause reduced noise cancellation by the feedback anti-noise. Although feedback filter 144 and gain element 146 are shown as separate components of ANC circuit 130, in some embodiments some structure and/or function of feedback filter 144 and gain element 146 may be combined. For example, in some of such embodiments, an effective gain of feedback filter 144 may be varied via control of one or more filter coefficients of feedback filter 144.

Playback corrected error PBCE may include the error microphone signal subtracted by a source audio signal, wherein such source audio signal may comprise a downlink audio signal ds and/or internal audio signal ia. By subtracting an amount of downlink audio signal ds and/or internal audio signal ia from the error microphone signal err, the feedback anti-noise signal generated from playback corrected error signal PBCE may correct only for ambient noise and not for audio present in the source audio signal.

Further, by transforming such inverter source audio signal with the estimate of the response of a secondary path S(z), the source audio signal should match the expected version of the source audio signal reproduced at error microphone signal err, because the electrical and acoustical path of S(z) is the path taken by the source audio signal to arrive at an error microphone that generates error microphone signal err.

To implement the above, ANC circuit 130 may include an adaptive filter 134 which in turn may have coefficients controlled by a secondary estimate (SE) coefficient control block 133, which may compare a reference signal comprising the source audio signal to playback corrected error signal PBCE. Adaptive filter 134 may apply a secondary estimate filter response SE(z) to the source audio signal to generate expected source audio signal delivered to the error microphone, which may be subtracted from error microphone signal err by combiner 136 to generate playback-corrected error PBCE. SE coefficient control block 133 may correlate the actual source audio signal with the components of the source audio signal that are present in error microphone signal err. Adaptive filter 134 may thereby be adapted to generate a signal from the source audio signal, that when subtracted from error microphone signal err, includes the content of error microphone signal err that is not due to the source audio signal.

Using the filtered error approach, a signal X(z) driving a loudspeaker may be given by:

$$X(z)=PB(z)-FB(z)PBCE(z) \tag{1}$$

wherein PB(z) represents the source audio signal, FB(z) represents a frequency response of feedback filter 144, and PBCE(z) represents playback corrected error signal PBCE generated by combiner 136. The playback corrected error signal in the z-domain may be given by:

$$PBCE(z)=E(z)-PB(z)SE(z) \tag{2}$$

wherein E(z) represents error microphone signal err and SE(z) is a frequency response of adaptive filter 134 that models the secondary path response S(z). The error microphone signal in the z-domain may be given by:

$$E(z)=X(z)S(z)+N(s) \tag{3}$$

wherein N(z) represents a residual noise present in an ear canal of a listener. Noise N(z) may be considered to include noise components not cancelled by other noise-cancellation mechanisms (e.g., feedforward active noise cancellation).

Substituting X(z) from equation (1) and E(z) from equation (3) into equation (2):

$$PBCE(z)=[PB(z)-FB(z)PBCE(z)]S(z)+N(z)-PB(z)SE(z) \tag{4}$$

which may be rearranged as:

$$PBCE(z) = PB(z)\frac{S(z) - SE(z)}{1 + FB(z)S(z)} + \frac{N(z)}{1 + FB(z)S(z)}$$

Equation (5) shows that playback corrected error signal PBCE may be scaled and phase shifted by the complex term 1+FB(z)S(z). If such term is not compensated for, it can cause divergence of adaptive filter 134. Accordingly, to generate a desired response signal to be compared by SE coefficient control block 133 to the reference signal (e.g., the source audio signal), a compensation filter 150 may apply a compensation response C(z) to playback corrected error signal PBCE to generate such desired response signal for use by SE coefficient control block 133. Because secondary response S(z) is unknown, such compensation filter must use secondary estimate response SE(z) instead of secondary response S(z). Further, because secondary estimate response SE(z) may at times fail to accurately estimate secondary response S(z), it may be necessary to provide a non-unity gain $G_{FB}$ for gain element 146, such that the compensation response C(z) becomes:

$$C(z)=1+G_{FB}FB(z)S(z)$$

Such filtering by compensation filter 150 may be computationally expensive, and gain control mechanisms may be challenging to implement. Accordingly, improved approaches to feedback active noise cancellation are desirable.

SUMMARY

In accordance with the teachings of the present disclosure, the disadvantages and problems associated with existing approaches to feedback active noise cancellation may be reduced or eliminated.

In accordance with embodiments of the present disclosure, a device may include a housing, a transducer coupled to the housing for reproducing an audio signal including both a source audio signal for playback to a listener and an anti-noise signal for countering the effects of ambient audio sounds in an acoustic output of the transducer, an error microphone coupled to the housing in proximity to the transducer for providing an error microphone signal indicative of the acoustic output of the transducer and the ambient audio sounds at the transducer, and a processing circuit. The processing circuit may implement a feedback filter having a response that generates the anti-noise signal from a playback corrected error, the playback corrected error based on a difference between the error microphone signal and a secondary path estimate signal, an adaptive secondary path estimate filter configured to model an electro-acoustic path of the source audio signal and have a secondary path estimate response that generates the secondary path estimate signal from the source audio signal, and a coefficient control block that shapes the response of the secondary path estimate filter in conformity with a reference signal and an internal error signal in order to minimize the ambient audio sounds at the transducer, wherein the reference signal is equal to a sum of the source audio signal and the anti-noise signal.

In accordance with these and other embodiments of the present disclosure, a method may be provided for use in a device comprising a transducer for reproducing an audio signal including both a source audio signal for playback to a listener and an anti-noise signal for countering the effects of ambient audio sounds in an acoustic output of the transducer and an error microphone coupled to the housing in proximity to the transducer for providing an error microphone signal indicative of the acoustic output of the transducer and the ambient audio sounds at the transducer. The method may include generating a response by a feedback filter having a response that generates the anti-noise signal from a playback corrected error, the playback corrected error based on a difference between the error microphone signal and a secondary path estimate signal, modelling, with an adaptive secondary path estimate filter, an electro-acoustic path of the source audio signal wherein the secondary path estimate filter has a secondary path estimate response that generates the secondary path estimate signal from the source audio signal, and shaping the response of the secondary path estimate filter in conformity with a reference signal and an internal error signal in order to minimize the ambient audio sounds at the transducer, wherein the reference signal is equal to a sum of the source audio signal and the anti-noise signal.

In accordance with these and other embodiments of the present disclosure, an integrated circuit may include an output configured to reproduce an audio signal including both a source audio signal for playback to a listener and an anti-noise signal for countering the effects of ambient audio sounds in an acoustic output of a transducer, an error microphone input configured to receive an error microphone signal indicative of the acoustic output of the transducer and the ambient audio sounds at the transducer, and a processing subcircuit. The processing subcircuit may implement a feedback filter having a response that generates the anti-noise signal from a playback corrected error, the playback corrected error based on a difference between the error microphone signal and a secondary path estimate signal, an adaptive secondary path estimate filter configured to model an electro-acoustic path of the source audio signal and have a secondary path estimate response that generates the secondary path estimate signal from the source audio signal, and a coefficient control block that shapes the response of the secondary path estimate filter in conformity with a reference signal and an internal error signal in order to minimize the ambient audio sounds at the transducer, wherein the reference signal is equal to a sum of the source audio signal and the anti-noise signal.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses noise canceling techniques and circuits that can be implemented in a personal audio device, such as a wireless telephone or portable music player. The personal audio device may include an ANC circuit that may measure the ambient acoustic environment and generate a signal that is injected in the speaker (or other transducer) output to cancel ambient acoustic events. An error microphone may be included for controlling the adaptation of the anti-noise signal to cancel the ambient audio sounds and for correcting for the electro-acoustic path from the output of the processing circuit through the transducer.

Figure 1A:
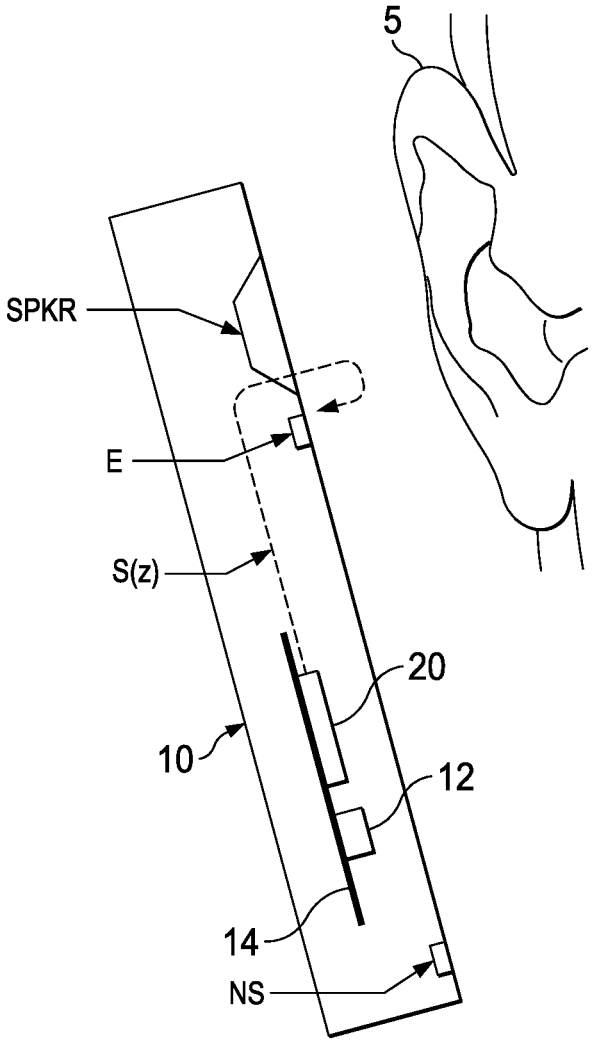
FIG. 1A is an illustration of an example portable audio device, in accordance with embodiments of the present disclosure.

Referring now to FIG. 1A, a personal audio device 10 as illustrated in accordance with embodiments of the present disclosure is shown in proximity to a human ear 5. Personal audio device 10 is an example of a device in which techniques in accordance with embodiments of this disclosure may be employed, but it is understood that not all of the elements or configurations embodied in illustrated personal audio device 10, or in the circuits depicted in subsequent illustrations, are required in order to practice the features recited in the claims. Personal audio device 10 may include a transducer such as speaker SPKR that reproduces distant speech received by personal audio device 10, along with other local audio events such as ringtones, stored audio program material, injection of near-end speech (i.e., the speech of the user of personal audio device 10) to provide a balanced conversational perception, and other audio that requires reproduction by personal audio device 10, such as sources from webpages or other network communications received by personal audio device 10 and audio indications such as a low battery indication and other system event notifications. A near-speech microphone NS may be provided to capture near-end speech, which is transmitted from personal audio device 10 to the other conversation participant(s).

Personal audio device 10 may include ANC circuits and features that inject an anti-noise signal into speaker SPKR to improve intelligibility of the distant speech and other audio reproduced by speaker SPKR. An error microphone E may be provided in order to enable ANC operation by providing a measure of the ambient audio combined with the audio reproduced by speaker SPKR close to ear 5, when personal audio device 10 is in close proximity to ear 5. In some embodiments, additional error microphones may be employed. In yet other embodiments, an ANC system may also include a reference microphone for hybrid feedforward and feedback ANC, but methods for feedforward ANC are beyond the scope of this disclosure.

Circuit 14 within personal audio device 10 may include an audio CODEC integrated circuit (IC) 20 that receives the signals from near-speech microphone NS and error microphone E and interfaces with other integrated circuits such as a radio-frequency (RF) integrated circuit 12 having a wireless telephone transceiver. In some embodiments of this disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure may measure ambient acoustic events (as opposed to the output of speaker SPKR and/or the near-end speech) impinging on error microphone E, and ANC processing circuits of personal audio device 10 adapt an anti-noise signal generated based on the output of error microphone E to have a characteristic that minimizes the amplitude of the ambient acoustic events at error microphone E. ANC circuits may operate to remove or reduce effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to personal audio device 10, when personal audio device 10 is not firmly pressed to ear 5. In personal audio devices designed only for audio playback, near-speech microphone NS will generally not be included, and the near-speech signal paths in the circuits described in further detail below may be omitted, without changing the scope of the disclosure, other than to limit the options provided for input to the microphone.

Figure 1B:
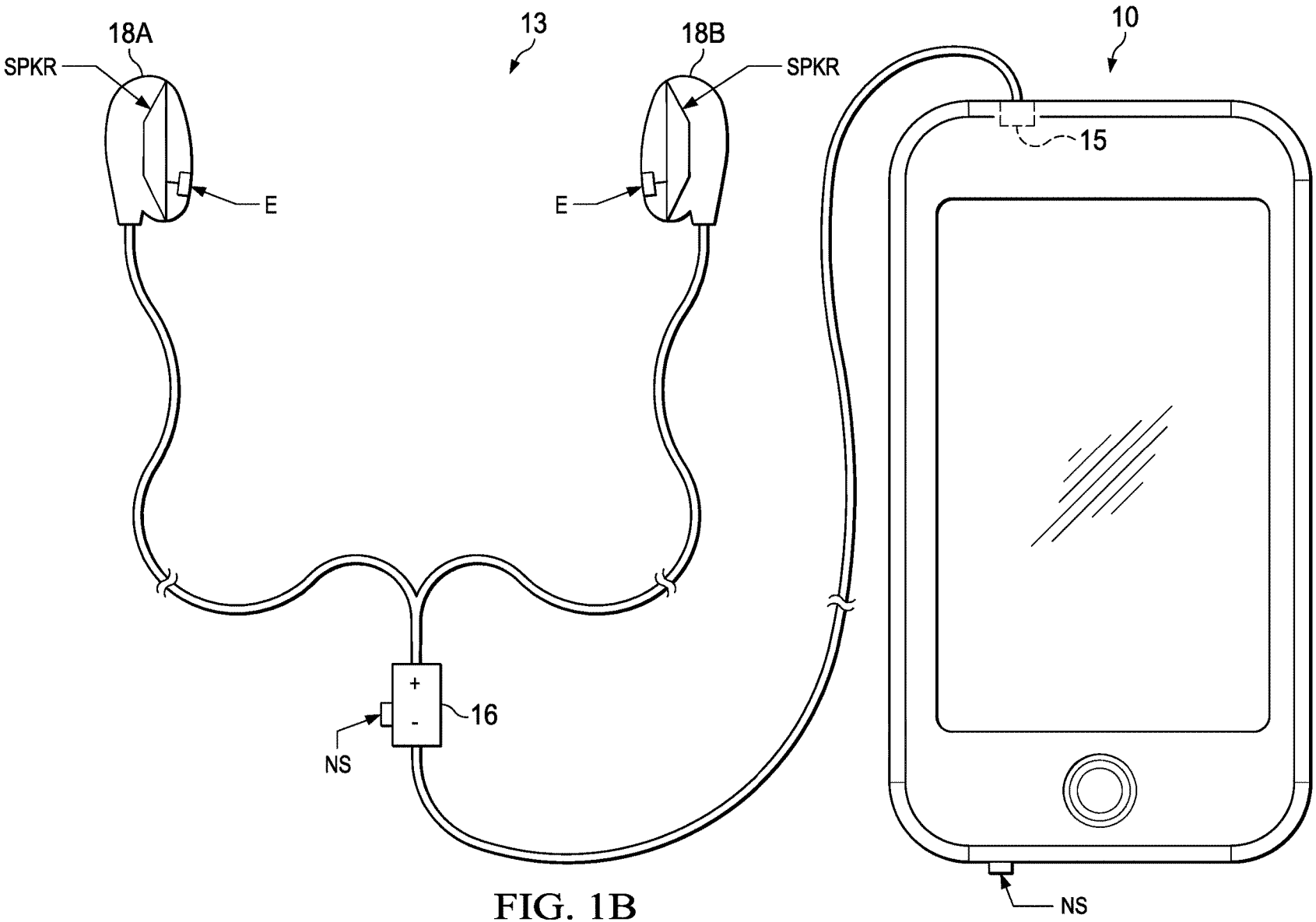
FIG. 1B is an illustration of an example portable audio device with a headphone assembly coupled thereto, in accordance with embodiments of the present disclosure.

Referring now to FIG. 1B, personal audio device 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 and/or CODEC IC 20. As shown in FIG. 1B, headphone assembly 13 may include a combox 16, a left headphone 18A, and a right headphone 18B. In some embodiments, headphone assembly 13 may comprise a wireless headphone assembly, in which case all or some portions of CODEC IC 20 may be present in headphone assembly 13, and headphone assembly 13 may include a wireless communication interface (e.g., BLUETOOTH) in order to communicate between headphone assembly 13 and personal audio device 10.

As used in this disclosure, the term "headphone" broadly includes any loudspeaker and structure associated therewith that is intended to be mechanically held in place proximate to a listener's ear canal, and includes without limitation earphones, earbuds, and other similar devices. As more specific examples, "headphone" may refer to intra-concha earphones, supra-concha earphones, and supra-aural earphones.

Combox 16 or another portion of headphone assembly 13 may have a near-speech microphone NS to capture near-end speech in addition to or in lieu of near-speech microphone NS of personal audio device 10. In addition, each headphone 18A, 18B may include a transducer such as speaker SPKR that reproduces distant speech received by personal audio device 10, along with other local audio events such as ringtones, stored audio program material, injection of near-end speech (i.e., the speech of the user of personal audio device 10) to provide a balanced conversational perception, and other audio that requires reproduction by personal audio device 10, such as sources from webpages or other network communications received by personal audio device 10 and audio indications such as a low battery indication and other system event notifications. Each headphone 18A, 18B may include an error microphone E for measuring of the ambient audio combined with the audio reproduced by speaker SPKR close to a listener's ear when such headphone 18A, 18B is engaged with the listener's ear. In some embodiments, CODEC IC 20 may receive the signals from error microphone E of each headphone 18 and near-speech microphone NS, and perform adaptive noise cancellation for each headphone as described herein. In other embodiments, a CODEC IC or another circuit may be present within headphone assembly 13, communicatively coupled to near-speech microphone NS and error microphone E, and configured to perform adaptive noise cancellation as described herein.

Figure 2:
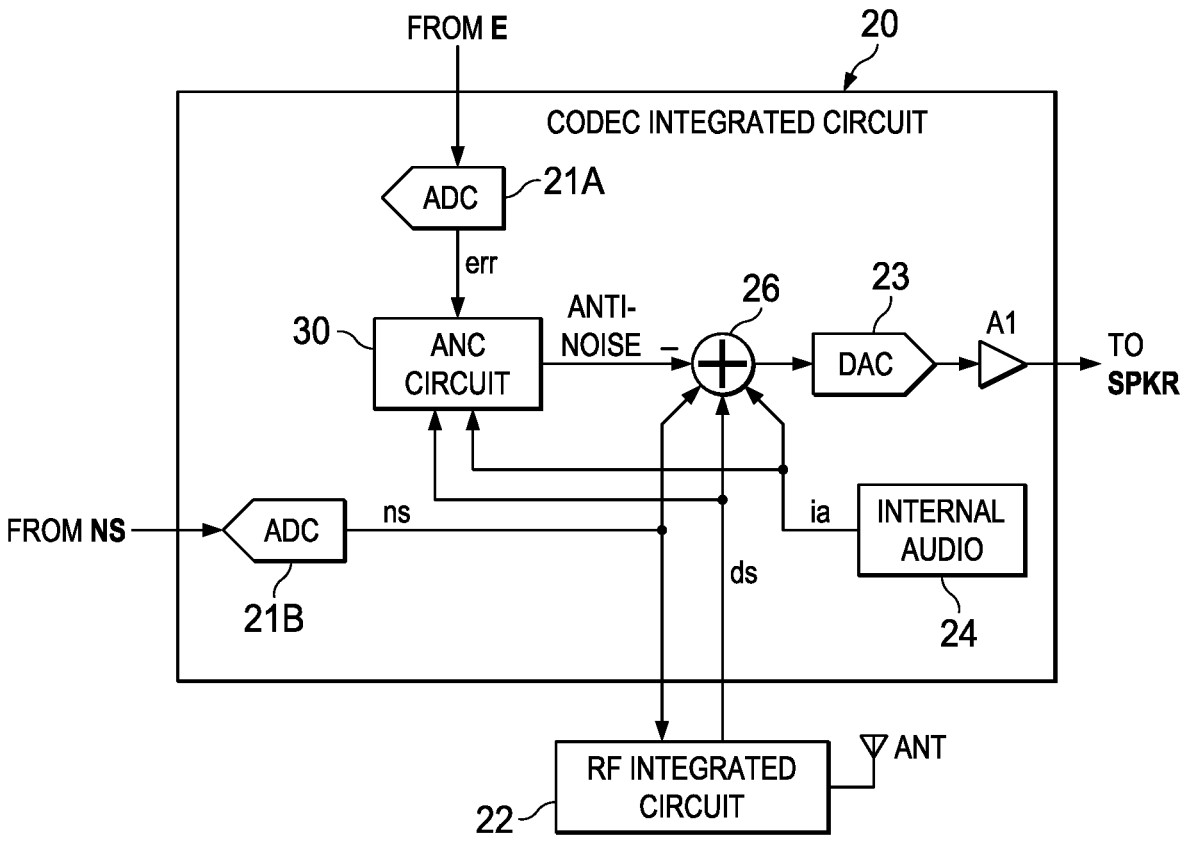
FIG. 2 is a block diagram of selected circuits within the portable audio device depicted in FIG. 1A, in accordance with embodiments of the present disclosure.
Figure 4:
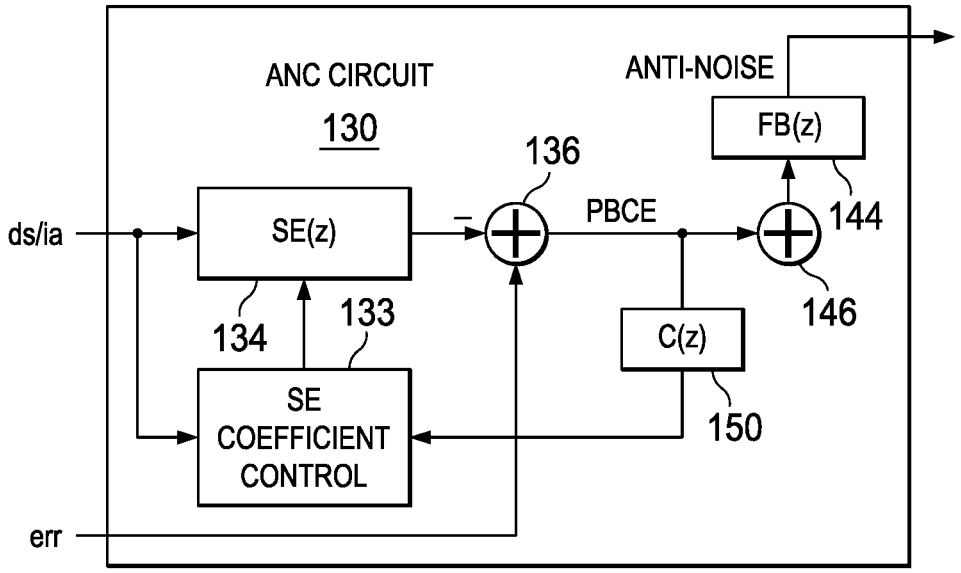
FIG. 4 is a block diagram depicting selected components of an ANC circuit, as is known in the art.

Referring now to FIG. 2, selected circuits within personal audio device 10 are shown in a block diagram, which in other embodiments may be placed in whole or in part in other locations such as one or more headphones or earbuds. CODEC IC 20 may include an analog-to-digital converter (ADC) 21A for receiving the error microphone signal from error microphone E and generating a digital representation err of the error microphone signal, and an ADC 21B for receiving the near speech microphone signal from near speech microphone NS and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine audio signals ia from internal audio sources 24, the anti-noise signal generated by ANC circuit 30, and a portion of near speech microphone signal ns so that the user of personal audio device 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT.

Figure 3:
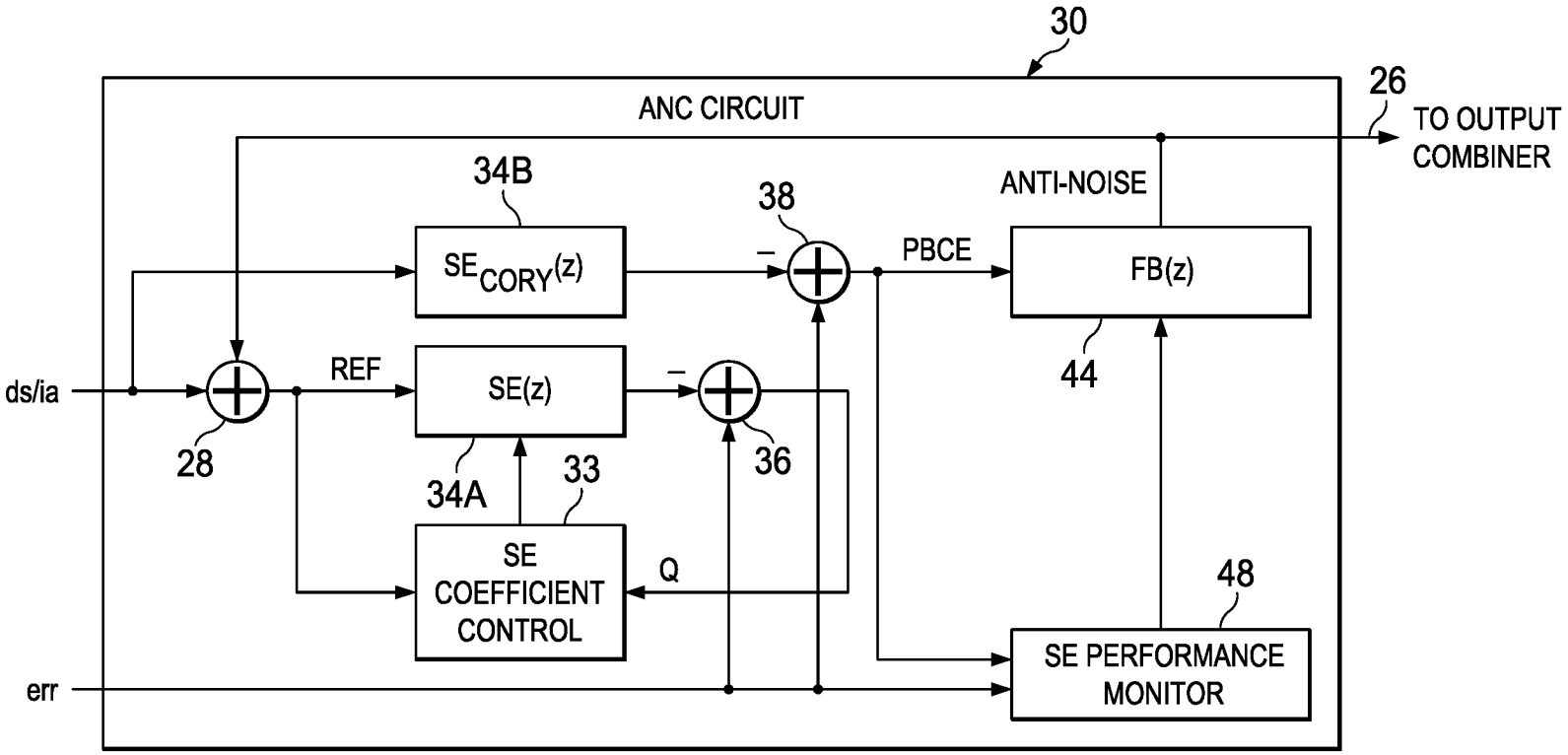
FIG. 3 is a block diagram depicting selected signal processing circuits and functional blocks within an example active noise canceling (ANC) circuit of a coder-decoder (CODEC) integrated circuit of FIG. 2, in accordance with embodiments of the present disclosure.

Referring now to FIG. 3, details of ANC circuit 30 are shown in accordance with embodiments of the present disclosure. As depicted in FIG. 3, ANC circuit 30 may comprise a feedback filter 44. Feedback filter 44 may receive a playback corrected error signal PBCE and may apply a response FB(z) to generate a feedback anti-noise signal based on playback corrected error signal PBCE which may be provided to output combiner 26 (e.g., such that output combiner 26 combines the anti-noise signal with a source audio signal to be reproduced by speaker SPKR).

Playback corrected error signal PBCE may include the error microphone signal err subtracted by a source audio signal, wherein such source audio signal may comprise a downlink audio signal ds and/or internal audio signal ia. By subtracting an amount of source audio signal from the error microphone signal err, the feedback anti-noise signal generated from playback corrected error signal PBCE may correct only for ambient noise and not for audio present in the source audio signal.

Further, by transforming such inverter source audio signal with a secondary estimate response $SE_{COPY}(z)$ of the response of a secondary path S(z), the source audio signal should match the expected version of the source audio signal reproduced at error microphone signal err, because the electrical and acoustical path of S(z) is the path taken by the source audio signal to arrive at error microphone E. To implement such transformation, ANC circuit 30 may include a filter 34B. Filter 34B may apply a secondary estimate filter response SE(z) to the source audio signal to generate an expected source audio signal delivered to error microphone E, which may be subtracted from error microphone signal err by a combiner 38 to generate playback-corrected error PBCE. In addition, ANC circuit 30 may include an adaptive filter 34A of which adaptive filter 34B may be a copy. Adaptive filter 34A may have coefficients controlled by a secondary estimate (SE) coefficient control block 33, which may compare and/or correlate a reference signal REF to an internal error signal Q in order to adapt filter coefficients of adaptive filter 34A (and filter 34B) in order to minimize correlation between reference signal REF and internal error signal Q such that secondary estimate response SE(z) (and secondary estimate response $SE_{COPY}(z)$) provides an accurate estimation of secondary response S(z). Such reference signal REF may comprise the source audio plus the anti-noise signal generated by feedback filter 44. Accordingly, reference signal REF may be equivalent to the audio output signal generated by combiner 26 depicted in FIG. 2. Thus, while FIG. 3 depicts a combiner 28 configured to generate such reference signal, in some embodiments, ANC circuit 30 may simply use the output of combiner 26 as reference signal REF.

Adaptive filter 34A may apply a secondary estimate filter response SE(z) to reference signal REF to generate a filtered reference signal, which may be subtracted from error microphone signal err by combiner 36 to generate internal error signal Q. SE coefficient control block 33 may correlate reference signal REF with internal error signal Q and adapt filter coefficients of adaptive filter 34A in order to minimize correlation between reference signal REF and internal error signal Q. A signal X(z) representing the output signal generated by combiner 26 for driving speaker SPKR may be given by:

$$X(z)=PB(z)-FB(z)PBCE(z) \tag{5}$$

wherein PB(z) represents the source audio signal, FB(z) represents a frequency response of feedback filter 44, and PBCE(z) represents playback corrected error signal PBCE generated by combiner 38. As described in the Background section of this Application, the playback corrected error signal in the z-domain may be given by:

$$PBCE(z)=[PB(z)-FB(z)PBCE(z)]S(z)+N(z)-PB(z)SE(z) \tag{6}$$

Via substitution of equation (6) into equation (5) and rearranging terms, X(z) may be given by:

$$X(z) = PB(z)\frac{1+FB(z)SE(z)}{1+FB(z)S(z)} - N(z)\frac{FB(z)}{1+FB(z)S(z)} \tag{7}$$

wherein SE(z) is a frequency response of adaptive filter 34A that models the secondary path response S(z) and N(z) represents a residual noise present in an ear canal of a listener. Noise N(z) may be considered to include noise components not cancelled by other noise cancellation mechanisms (e.g., feedforward active noise cancellation).

Internal error signal Q may be given by:

$$Q(z)=E(z)-X(z)SE(z) \tag{8}$$

wherein E(z) represents error microphone signal err. Upon substituting for E(z) using equation (3) from the Background section into equation (8) and rearranging terms:

$$Q(z)=X(z)[S(z)-SE(z)]+N(z) \tag{9}$$

Substituting for X(z) as given in equation (7) into equation (9):

$$Q(z) = PB(z)[S(z) - SE(z)]\frac{1 + FB(z)SE(z)}{1 + FB(z)S(z)} + N(z)\frac{1 + FB(z)SE(z)}{1 + FB(z)S(z)} \tag{10}$$

Comparing equation (4) set forth in the Background section and equation (10) above, it may be observed that:

$$Q(z)=PBCE(z)(1+FB(z)SE(z)] \tag{11}$$

Equation (11) shows that the approach of ANC circuit 30 incorporates the filtering response 1+FB(z)SE(z) that is required in the filtered-error approach described in the Background section, thus eliminating the expense and challenges of incorporating a filter (e.g., compensation filter 150 in FIG. 5) within an ANC circuit to perform such filtering response.

Further, while equation (7) indicates that output signal X(z) and noise N(z) are now correlated, which could lead to biased estimates of secondary response S(z), such issue may be mitigated by the fact that in practice, N(z) may be strongly attenuated by feedback filter 44 and may form a small fraction of output signal X(z), especially when adaptation is performed only in the presence of adequate playback-to-noise ratio.

As shown in FIG. 3, ANC circuit 30 may also comprise secondary path estimate performance monitor 48. Secondary path estimate performance monitor 48 may comprise any system, device, or apparatus configured to compare error microphone signal err to the playback-corrected error microphone signal, thus giving an indication of how efficiently secondary path estimate adaptive filter 34A is modeling the electro-acoustic path of the source audio signal over various frequencies, as determined by the efficiency by which secondary path estimate adaptive filter 34A causes combiner 38 to remove the source audio signal from the error microphone signal in generating the playback-corrected error PBCE over various frequencies.

Responsive to a determination by secondary path estimate performance monitor 48 that secondary path estimate adaptive filter 34A is not sufficiently modeling the electro-acoustic path of the source audio signal for a frequency range of sound, one or more components of CODEC IC 20 may perform an action. For example, responsive to a determination that secondary path estimate adaptive filter 34A is not sufficiently modeling the electro-acoustic path in a frequency range, CODEC IC 20 may boost a source audio signal comprising signals ds and/or is within the frequency range. As another example, responsive to a determination that secondary path estimate adaptive filter 34A is not sufficiently modeling the electro-acoustic path in a frequency range, secondary path estimate performance monitor 48 may disable feedback filter 44 from generating the feedback anti-noise component and/or reduce the effective gain of feedback filter 44 (e.g., relative to the effective gain employed when secondary path estimate adaptive filter 34A is sufficiently modeling the electro-acoustic path). As another example, responsive to a determination that secondary path estimate adaptive filter 34A is not sufficiently modeling the electro-acoustic path in a frequency range, secondary path estimate performance monitor 48 may disable secondary path estimate adaptive filter 34A from adapting, may mute secondary path estimate adaptive filter 34A (e.g., disable it from generating the feedforward anti-noise component), and/or may reset secondary path estimate adaptive filter 34A.

Further, as described in U.S. Pat. No. 9,294,836, which is incorporated by reference herein in its entirety, SE performance monitor 48 may be used to determine the acoustic coupling between a headphone 18A or 18B and a listener's ear. For example, SE performance monitor 48 may determine that SE(z) is much different than S(z), as may occur when a headphone 18A or 18B is removed from a listener's ear. In response to a determination that a headphone 18A or 18B is removed from a listener's ear, CODEC IC 20 may take appropriate action, including the freezing of adaption of ANC circuit 30 and/or reducing the feedback anti-noise signal to zero.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. A device comprising:

a housing;

a transducer coupled to the housing for reproducing an audio signal including both a source audio signal for playback to a listener and an anti-noise signal for countering the effects of ambient audio sounds in an acoustic output of the transducer;

an error microphone coupled to the housing in proximity to the transducer for providing an error microphone signal indicative of the acoustic output of the transducer and the ambient audio sounds at the transducer; and a processing circuit that implements:

a feedback filter having a response that generates the anti-noise signal from a playback corrected error, the playback corrected error based on a difference between the error microphone signal and a secondary path estimate signal;

an adaptive secondary path estimate filter configured to model an electro-acoustic path of the source audio signal and have a secondary path estimate response that generates the secondary path estimate signal from the source audio signal; and a coefficient control block that shapes the response of the secondary path estimate filter in conformity with a reference signal and an internal error signal in order to minimize the ambient audio sounds at the transducer, wherein the reference signal is equal to a sum of the source audio signal and the anti-noise signal.

2. The device of claim 1, wherein the internal error signal is based on a difference between the error microphone signal and the reference signal as filtered by a second adaptive secondary path estimate filter that has the secondary path estimate response.

3. The device of claim 1, wherein the processing circuit further implements a secondary path estimate monitor configured to determine whether the secondary path estimate response sufficiently models the electro-acoustic path.

4. The device of claim 3, wherein the secondary path estimate monitor is further configured to determine an acoustic coupling of the transducer to an ear of a listener based on whether the secondary path estimate response sufficiently models the electro-acoustic path.

5. A method comprising, in a device comprising a transducer for reproducing an audio signal including both a source audio signal for playback to a listener and an anti-noise signal for countering the effects of ambient audio sounds in an acoustic output of the transducer and an error microphone coupled to the housing in proximity to the transducer for providing an error microphone signal indicative of the acoustic output of the transducer and the ambient audio sounds at the transducer:

generating a response by a feedback filter having a response that generates the anti-noise signal from a playback corrected error, the playback corrected error based on a difference between the error microphone signal and a secondary path estimate signal;

modelling, with an adaptive secondary path estimate filter, an electro-acoustic path of the source audio signal wherein the secondary path estimate filter has a secondary path estimate response that generates the secondary path estimate signal from the source audio signal; and shaping the response of the secondary path estimate filter in conformity with a reference signal and an internal error signal in order to minimize the ambient audio sounds at the transducer, wherein the reference signal is equal to a sum of the source audio signal and the anti-noise signal.

6. The method of claim 5, wherein the internal error signal is based on a difference between the error microphone signal and the reference signal as filtered by a second adaptive secondary path estimate filter that has the secondary path estimate response.

7. The method of claim 5, further comprising determining whether the secondary path estimate response sufficiently models the electro-acoustic path.

8. The method of claim 7, further comprising determining an acoustic coupling of the transducer to an ear of a listener based on whether the secondary path estimate response sufficiently models the electro-acoustic path.

9. An integrated circuit comprising:

an output configured to reproduce an audio signal including both a source audio signal for playback to a listener and an anti-noise signal for countering the effects of ambient audio sounds in an acoustic output of a transducer;

an error microphone input configured to receive an error microphone signal indicative of the acoustic output of the transducer and the ambient audio sounds at the transducer;

a processing subcircuit that implements:

a feedback filter having a response that generates the anti-noise signal from a playback corrected error, the playback corrected error based on a difference between the error microphone signal and a secondary path estimate signal;

an adaptive secondary path estimate filter configured to model an electro-acoustic path of the source audio signal and have a secondary path estimate response that generates the secondary path estimate signal from the source audio signal; and a coefficient control block that shapes the response of the secondary path estimate filter in conformity with a reference signal and an internal error signal in order to minimize the ambient audio sounds at the transducer, wherein the reference signal is equal to a sum of the source audio signal and the anti-noise signal.

10. The integrated circuit of claim 9, wherein the internal error signal is based on a difference between the error microphone signal and the reference signal as filtered by a second adaptive secondary path estimate filter that has the secondary path estimate response.

11. The integrated circuit of claim 9, wherein the processing subcircuit further implements a secondary path estimate monitor configured to determine whether the secondary path estimate response sufficiently models the electro-acoustic path.

12. The integrated circuit of claim 11, wherein the secondary path estimate monitor is further configured to determine an acoustic coupling of the transducer to an ear of a listener based on whether the secondary path estimate response sufficiently models the electro-acoustic path.

* * * * *